US009779650B2

(12) United States Patent
Lin et al.

(10) Patent No.: US 9,779,650 B2
(45) Date of Patent: Oct. 3, 2017

(54) DISPLAY DEVICE AND DRIVING METHOD OF DISPLAY PANEL

(71) Applicant: Chunghwa Picture Tubes, LTD., Taoyuan (TW)

(72) Inventors: Hsiang-Tan Lin, Keelung (TW); Pei-Lin Hsieh, Taoyuan (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 71 days.

(21) Appl. No.: 15/074,997

(22) Filed: Mar. 18, 2016

(65) Prior Publication Data

US 2017/0200406 A1 Jul. 13, 2017

(30) Foreign Application Priority Data

Jan. 8, 2016 (CN) ..... 2016 1 0011305

(51) Int. Cl.
*G09G 5/10* (2006.01)
*G09G 3/20* (2006.01)

(52) U.S. Cl.
CPC ... *G09G 3/2003* (2013.01); *G09G 2320/0673* (2013.01); *G09G 2340/06* (2013.01)

(58) Field of Classification Search
CPC ... G09G 3/3406; G09G 3/3648; G09G 3/3611
USPC ..... 345/87, 88, 102–103, 690
See application file for complete search history.

(56) References Cited

U.S. PATENT DOCUMENTS 8,952,980 B2 2/2015 Hansen et al.

FOREIGN PATENT DOCUMENTS

| | | |
|---|---|---|
| TW | I251197 | 3/2006 |
| TW | 201115503 | 5/2011 |
| TW | I344213 | 6/2011 |
| TW | I398837 | 6/2013 |

*Primary Examiner* — Calvin C Ma
(74) *Attorney, Agent, or Firm* — J.C. Patents

(57) ABSTRACT

A display device and a method of driving a display panel. The display device includes a color calculating unit, a color data converting unit, a display and a panel driving unit. The color calculating unit supplies a first, a second, a third, and a fourth color data to the color data converting unit according to an image data. The color data converting unit outputs a first, a second, a third, and a fourth display data to the panel driving unit. A panel driving unit outputs a first, a second, and a third pixel voltages according to a first gamma curve to drive a first, a second, and a third color pixels of the display panel, and outputs a fourth pixel voltage according to a second gamma curve to drive a fourth color pixel of the display panel, wherein the first gamma curve is different from the second gamma curve.

14 Claims, 2 Drawing Sheets

200

DISPLAY DEVICE AND DRIVING METHOD OF DISPLAY PANEL

CROSS-REFERENCE TO RELATED APPLICATION

This application claims the priority benefit of China application serial no. 201610011305.1, filed on Jan. 8, 2016. The entirety of the above-mentioned patent application is hereby incorporated by reference herein and made a part of this specification.

BACKGROUND OF THE INVENTION

Field of the Invention

The invention relates to a display device and a driving method of a display panel.

Description of Related Art

On the market, the display device is generally designed to exhibit three primary colors only (such as red color, green color, and blue color) and the number of data bits is, for example, 8 bits, therefore, a single color is only able to render 256 gradations and the color rendering method is monotonic method, so the gradations are unable to be more widely varied. In order to improve the effectiveness of the gradations displayed by the screen of the display panel, a driving chip may be used to drive a higher number of data bits (such as 10 bits), so as to greatly increase the hardware cost of the display device.

SUMMARY OF THE INVENTION

The invention provides a display device and a driving method of a display panel, the display panel has at least four color pixels, and pixel voltages required to drive the pixels are generated according to at least two different gamma curves. Thereby, the gradation variation displayed by the screen is increased to improve the image layering displayed by the display panel and to optimize quality of the displayed image.

According to an embodiment of the invention, a display device includes a color calculating unit, a color data converting unit, a display panel, and a panel driving unit. The color calculating unit receives an image data to supply a first color data, a second color data, a third color data, and a fourth color data according to the image data. The color data converting unit couples to the color calculating unit and receives the first color data, the second color data, the third color data, and the fourth color data, and converts the first color data, the second color data, the third color data, and the fourth color data to a first display data, a second display data, a third display data, and a fourth display data respectively for outputting. The display panel has a first color pixel, a second color pixel, a third color pixel, and a fourth color pixel. The panel driving unit is coupled to the color data converting unit and the display panel, converts the first display data, the second display data, and the third display data to a first pixel voltage, a second pixel voltage, and a third pixel voltage according to a first gamma curve, and converts the fourth display data to a fourth pixel voltage according to a second gamma curve, wherein the first pixel voltage is used to drive the first color pixel, the second pixel voltage is used to drive the second color pixel, the third pixel voltage is used to drive the third color pixel, the fourth pixel voltage is used to drive the fourth color pixel, and the first gamma curve is different from the second gamma curve.

According to an embodiment of the invention, a driving method of a display panel includes following steps. A first color data, a second color data, a third color data, and a fourth color data are supplied according to an image data by a color calculating unit. The first color data, the second color data, the third color data, and the fourth color data are converted to a first display data, a second display data, a third display data, and a fourth display data respectively by a color data converting unit. The first display data, the second display data, and the third display data are converted to a first pixel voltage, a second pixel voltage, and a third pixel voltage according to a first gamma curve to transmit to a display panel by a panel driving unit, so as to drive a first color pixel, a second color pixel, and a third color pixel. The fourth display data is converted to a fourth pixel voltage according to a second gamma curve to transmit to the display panel by the panel driving unit, so as to drive a fourth color pixel of the display panel, wherein the first gamma curve is different from the second gamma curve.

The embodiments of the invention provide a display device and a driving method of a display panel, the display panel has at least four color pixels, and the pixel voltages required to drive the pixels are generated according to at least two different gamma curves. Thereby, the gradation variation displayed by the screen is increased to improve the image layering displayed by the display panel and to optimize quality of the displayed image.

DESCRIPTION OF THE EMBODIMENTS

Figure 1:
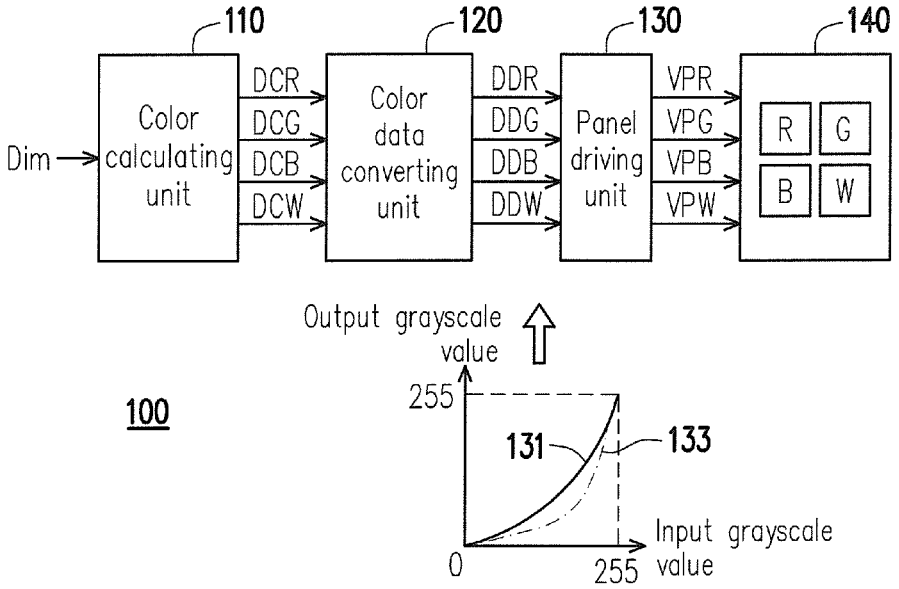
FIG. 1 is a schematic system view of a display device according to an embodiment of the invention.

FIG. 1 is a schematic system view of a display device according to an embodiment of the invention. Referring to FIG. 1, the present embodiment, a display device 100 includes a color calculating unit 110, a color data converting unit 120, a panel driving unit 130, and a display panel 140, wherein a plurality of pixels having different chromas are disposed on the display panel 140 to display a color image, and the color calculating unit 110 and the panel driving unit 130 are actualized by hardware (such as in circuit form).

In the present embodiment, the pixels on the display panel 140 includes a red pixel R (corresponding to a first color pixel), a green pixel G (corresponding to a second color pixel), a blue pixel B (corresponding to a third color pixel), and a white pixel W (corresponding to a fourth color pixel). In addition, the red pixel R, the green pixel G, the blue pixel B, and the white pixel W are arranged in a matrix form, but in other embodiments, the red pixel R, the green pixel G, the blue pixel B, and the white pixel W may be arranged in horizontal direction, arranged in vertical direction, or arranged in a zigzag manner, the invention is not limited thereto.

Based on the above, after receiving an image data Dim, the color calculating unit 110 generates a red color data DCR (corresponding to a first color data), a green color data DCG (corresponding to a second color data), a blue color data DCB (corresponding to a third color data), and a white color data DCW (corresponding to a fourth color data) according to the image data Dim. In addition, the color calculating unit 110 is coupled to the color data converting unit 120 to supply the red color data DCR, the green color data DCG, the blue color data DCB, and the white color data DCW to the color data converting unit 120. Wherein, the number of data bits of the red color data DCR, the green color data DCG, the blue color data DCB, and the white color data DCW (such as 10 bits) is greater than or equal to the number of data bits of the image data Dim (such as 8 bits or 10 bits), so it convenient for the color data converting unit 120 to perform data computation.

After receiving the red color data DCR, the green color data DCG, the blue color data DCB, and the white color data DCW, the color data converting unit 120 converts the red color data DCR, the green color data DCG, the blue color data DCB, and the white color data DCW to a red display data DDR (corresponding to a first display data), a green display data DDG (corresponding to a second display data), a blue display data DDB (corresponding to a third display data), and a white display data DDW (corresponding to a fourth display data) respectively. In addition, the color data converting unit 120 is coupled to the panel driving unit 130 so as to output the red display data DDR, the green display data DDG, the blue display data DDB, and the white display data DDW to the panel driving unit 130. Wherein, the number of data bits of the red display data DDR, the green display data DDG, the blue display data DDB, and the white display data DDW is smaller than the number of data bits of the red color data DCR, the green color data DCG, the blue color data DCB, and the white color data DCW.

After receiving the red display data DDR, the green display data DDG, the blue display data DDB, and the white display data DDW, the panel driving unit 130 converts the red display data DDR, the green display data DDG, and the blue display data DDB to a red pixel voltage VPR (corresponding to a first pixel voltage), a green pixel voltage VPG (corresponding to a second pixel voltage), and a blue pixel voltage VPB (corresponding to a third pixel voltage) according to a gamma curve 131 (corresponding to a first gamma curve), and coverts the white display data DDW to a white pixel voltage VPW (corresponding to a fourth pixel voltage) according to a gamma curve 133 (corresponding to a second gamma curve). The panel driving unit 130 is coupled to the display panel 140 to supply the red pixel voltage VPR, the green pixel voltage VPG, the blue pixel voltage VPB, and the white pixel voltage VPW to the display panel 140, wherein the red pixel voltage VPR is used to drive the red pixel R, the green pixel voltage VPG is used to drive the green pixel G, the blue pixel voltage VPB is used to drive the blue pixel B, the white pixel voltage VPW is used to drive the white pixel W, and the gamma curve 131 is different from the gamma curve 133.

Based on the above, with the same input grayscale value (it means that the red color data DCR, the green color data DCG, the blue color data DCB, and the white color data DCW represent the same grayscale value), the brightness (or the output grayscale value) displayed by the red color data DCR, the green color data DCG, and the blue color data DCB is different from the brightness of the white color data DCW, so as to increase the gradation variation displayed by the screen, to improve the image layering displayed by the display panel 140, and to optimize quality of the displayed image. In addition, via harmonizing different gamma curves (such as 131, 133), the display panel 140 may display fine image layering at low gray scales conforming to a digital imaging and communications in medicine (DICOM) curve of a DICOM standard, wherein the DICOM Curve is designed for the medical display.

Furthermore, via adjusting different gamma curves (such as 131, 133), the user may freely assign the number of gradation values corresponding to each of the grayscale segments (brightness range), for example, the number the gradation values corresponding to the low grayscale segment (i.e., the output grayscale value is from 0 to 84) is assigned to be higher than the number the gradation values corresponding to the medium and high grayscale segments (i.e., the output grayscale value is from 85 to 255) to match with the tendency and ability to distinguish brightness changes of human eyes, wherein the number of levels that the human eyes can distinguish in the low grayscale segment is much larger than the number of levels that the human eyes can distinguish in the high grayscale segment. In addition, the hardware cost is greatly reduced when applying to high-end professional display devices (reducing the hardware cost of the driving chip (IC)), that is to say, the high-bit IC is not necessary to be used, for example, using 8-bit chip can achieve the effect of using 10-bit chip, wherein the high-end professional display devices are display devices used in, for instance, medical, professional drawing, high-quality professional photography, high-end consumer television, high-end monitoring, etc.

In the present embodiment, the image data Dim is converted to the red color data DCR, the green color data DCG, the blue color data DCB, and the white color data DCW by the color calculating unit 110, but in other embodiments, some video sources may supply high-bit image data so the color calculating unit 110 may be omitted, that is to say, the color calculating unit 110 may be used or omitted according to circuit design, but the invention is not limited thereto.

In an embodiment of the invention, the methods for converting the red color data DCR, the green color data DCG, and the blue color data DCB to the red display data DDR, the green display data DDG, and the blue display data DDB respectively may be described as followings. The first method is that, take the red color data DCR as an example, dividing the red color data DCR by 2^(bit difference) to obtain the red display data DDR, for example, the number of data bits of the red color data DCR is 10 and the number of data bits of the red display data DDR is 8 which is equal to the red color data DCR divided by 4 (2^(10−8)). The second method is that, take the red color data DCR as an example, converting the red color data DCR to a binary number and discarding the last two bits and then converting back to a decimal number, for example, 8 (decimal number) is equal to 1000 (binary number), the last two bits of 1000 (binary number) is discarded to obtain 10 (binary number), and 10 (binary number) is equal to 2 (decimal number).

In the embodiments of the invention, the aforementioned calculating methods may be coded as a program, and the program is executed by the central processor to perform data conversion. In some embodiments, a lookup table may be used to replace the aforementioned calculating methods, in other words, the corresponding relation between the red color data DCR and the red display data DDR, the green color data DCG and the green display data DDG, and the blue color data DCB and the blue display data DDB is recorded in the lookup table of the color data converting unit 120. Take the 10 data bit red color data DCR converting to the 8 data bit red display data DDR as an example, the size of the lookup table is 1024×2 to record the corresponding relation between the red color data DCR and the red display data DDR.

In an embodiment of the invention, the method for converting the white color data DCW to the white display data DDW may be described as followings. Hypothetically, the data bits of the white color data DCW are 10 bits, the data bits of the white display data DDW are 8 bits, the index of the gamma curve 131 is 2.2, and the index of the gamma curve 133 is 3.5. Firstly, the white color data DCW is converted to a corresponding brightness value B1 (between 0 and 1) according to the gamma curve 131, for example, B1 is equal to (DCW/M)^2.2, wherein M is the maximum that the white color data DCW can represent (in this situation, M is equal to 1023). Next, the white color data DCW is divided by 2^(bit difference) and the result is rounded down to an integer, and the integer is converted to a corresponding brightness value B2 (between 0 and 1) according to the gamma curve 131, for example, B2 is equal to (integer (DCW/C)/N)^2.2, wherein C is equal to 4 (2^(10−8)), N is the maximum that the white display data DDW can represent (in this situation, N is equal to 255). Finally, the brightness value B1 is multiplied by D and the brightness value B2 is subtracted from the result to obtain a value, the value is reversely converted to a grayscale value according to the gamma curve 133 to serve as the grayscale value of the white display data DDW, that is to say, DDW=Integer ((B1*D−B2)^(1/3.5)*N), wherein D is equal to the sum of the maximum that the brightness value B1 can represent and the maximum that the brightness value B2 can represent, namely 1+1=2.

In the embodiments of the invention, the aforementioned calculating method may also be coded as a program, and the program is executed by the central processor to perform data conversion. In some embodiments, a lookup table may be used to replace the aforementioned calculating method, in other words, the corresponding relation between the white color data DCW and the white display data DDW is recorded in the lookup table of the color data converting unit 120. Take the 10 data bit white color data DCW converting to the 8 data bit white display data DDW as an example, the size of the lookup table is 1024×2 to record the corresponding relation between the white color data DCW and the white display data DDW.

Figure 2:
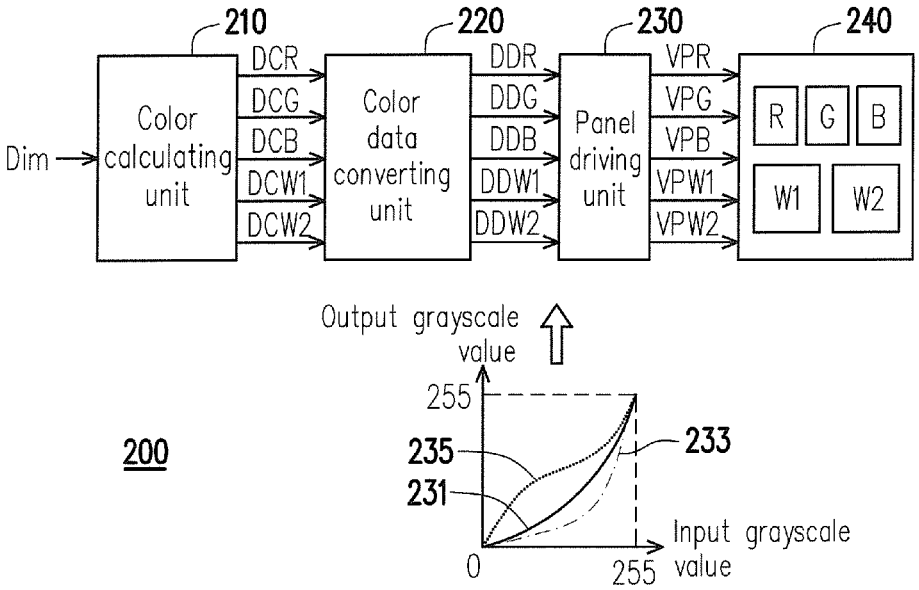
FIG. 2 is a schematic system view of a display device according to another embodiment of the invention.

FIG. 2 is a schematic system view of a display device according to another embodiment of the invention. Referring to FIG. 2, in the present embodiment, the display device 200 includes a color calculating unit 210, a color data converting unit 220, a panel driving unit 230, and a display panel 240, wherein a red pixel R (corresponding to a first color pixel), a green pixel G (corresponding to a second color pixel), a blue pixel B (corresponding to a third color pixel), a white pixel W1 (corresponding to a fourth color pixel), and a white pixel W2 (corresponding to a fifth color pixel) disposed on the display panel 240, and the white pixel W1 and the white pixel W2 are corresponding to different chromas. In addition, the red pixel R, the green pixel G, and the blue pixel B are arranged in parallel with the white pixel W1 and the white pixel W2, but in other embodiments, the red pixel R, the green pixel G, the blue pixel B, the white pixel W1, and the white pixel W2 may be arranged in horizontal direction, arranged in vertical direction, or arranged in a zigzag manner, the invention is not limited thereto.

The color calculating unit 210 generates a red color data DCR (corresponding to a first color data), a green color data DCG (corresponding to a second color data), a blue color data DCB (corresponding to a third color data), a white color data DCW1 (corresponding to a fourth color data), and a white color data DCW2 (corresponding to a fifth color data) according to the image data Dim. Wherein, the number of data bits (such as 10 bits) of the red color data DCR, the green color data DCG, the blue color data DCB, the white color data DCW1, and the white color data DCW2 is greater than or equal to the number of data bits (such as 8 bits or 10 bits) of the image data Dim, so it convenient for the color data converting unit 120 to perform data computation.

After receiving the red color data DCR, the green color data DCG, the blue color data DCB, the white color data DCW1, and the white color data DCW2, the color data converting unit 220 converts the red color data DCR, the green color data DCG, the blue color data DCB, the white color data DCW1, and the white color data DCW2 to a red display data DDR (corresponding to a first display data), a green display data DDG (corresponding to a second display data), a blue display data DDB (corresponding to a third display data), a white display data DDW1 (corresponding to a fourth display data), and a white display data DDW2 (corresponding to a fifth display data) respectively. Wherein, the number of data bits of the red display data DDR, the green display data DDG, the blue display data DDB, the white display data DDW1, and the white display data DDW2 is smaller than the number of data bits of the red color data DCR, the green color data DCG, the blue color data DCB, the white color data DCW1, and the white color data DCW2.

After receiving the red display data DDR, the green display data DDG, the blue display data DDB, the white display data DDW1, and the white display data DDW2, the panel driving unit 230 converts the red display data DDR, the green display data DDG, and the blue display data DDB to a red pixel voltage VPR (corresponding to a first pixel voltage), a green pixel voltage VPG (corresponding to a second pixel voltage), and a blue pixel voltage VPB (corresponding to a third pixel voltage) according to a gamma curve 231 (corresponding to a first gamma curve), coverts the white display data DDW1 to a white pixel voltage VPW1 (corresponding to a fourth pixel voltage) according to a gamma curve 233 (corresponding to a second gamma curve), and converts the white display data DDW2 to a white pixel voltage VPW2 (corresponding to a fifth pixel voltage) according to a gamma curve 235 (corresponding to a third gamma curve). The panel driving unit 230 supplies the red pixel voltage VPR, the green pixel voltage VPG, the blue pixel voltage VPB, the white pixel voltage VPW1, and the white pixel voltage VPW2 to the display panel 240, wherein the red pixel voltage VPR is used to drive the red pixel R, the green pixel voltage VPG is used to drive the green pixel G, the blue pixel voltage VPB is used to drive the blue pixel B, the white pixel voltage VPW1 is used to drive the white pixel W1, the white pixel voltage VPW2 is used to drive the white pixel W2, and the gamma curves 231, 233, and 235 are different from each other.

In the above embodiment, the white display data DDW1 and the white display data DDW2 are respectively converted to the white pixel voltage VPW1 and the white pixel voltage VPW2 according to different gamma curves (such as 233 and 235), but in other embodiments, the white display data DDW1 and the white display data DDW2 are respectively converted to the white pixel voltage VPW1 and the white pixel voltage VPW2 according to the same gamma curve (such as 233 or 235), the invention is not limited thereto.

In the above embodiment, the additional color pixels all are the white pixel (such as W, W1, and W2) as an example, in other embodiments, the additional color pixels may be a color pixel similar as the red pixel R, the green pixel G, or the blue pixel B, or complementary color pixels (such as yellow color pixel, orange color pixel, and purple color pixel), and may be determined by a person of ordinary skill in the art. Moreover, in the above embodiment, the number of the additional color pixels is 1 or 2 for instance, but in other embodiments, the number of the additional color pixels is determined according to the circuit design, and the arranging method is also determined according to the circuit design, the invention is not limited thereto. Furthermore, the gamma curves that the additional color pixels is based on may be the same or different, and may be determined according to the appearance requirements of the user.

Figure 3:
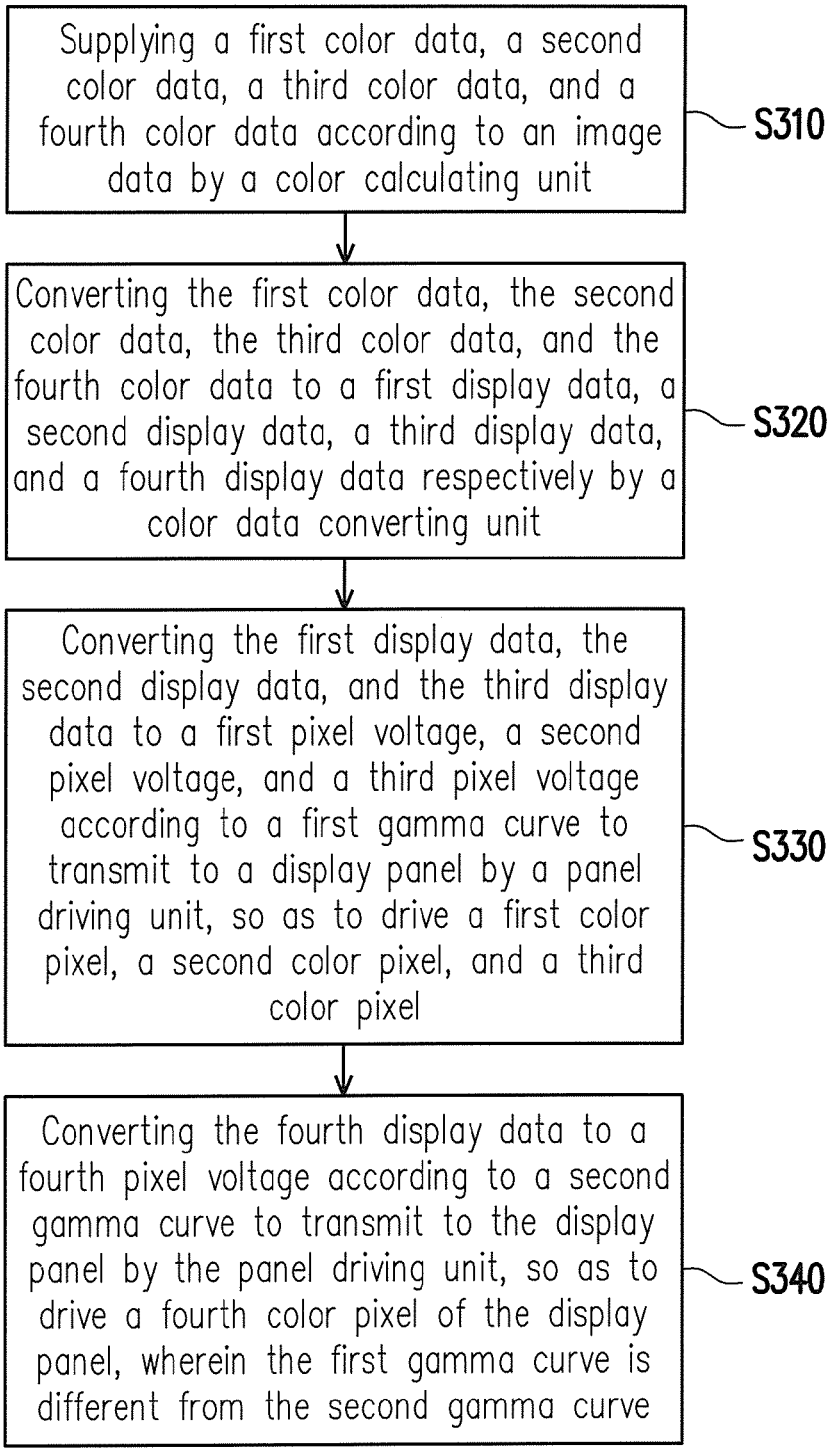
FIG. 3 is a flowchart illustrating a driving method of a display panel according to an embodiment of the invention.

FIG. 3 is a flowchart illustrating a driving method of a display panel according to an embodiment of the invention. Referring to FIG. 3, in the present embodiment, a driving method of a display panel inside a display device is described as followings. In step S310, a first color data, a second color data, a third color data, and a fourth color data are supplied according to an image data by a color calculating unit. In step S320, the first color data, the second color data, the third color data, and the fourth color data are converted to a first display data, a second display data, a third display data, and a fourth display data respectively by a color data converting unit. Next, in step S330, the first display data, the second display data, and the third display data are converted to a first pixel voltage, a second pixel voltage, and a third pixel voltage according to a first gamma curve to transmit to a display panel by a panel driving unit, so as to drive a first color pixel, a second color pixel, and a third color pixel. Moreover, in step S340, the fourth display data is converted to a fourth pixel voltage according to a second gamma curve to transmit to the display panel by the panel driving unit, so as to drive a fourth color pixel of the display panel, wherein the first gamma curve is different from the second gamma curve. Wherein, the sequence of the steps S310, S320, S330, and S340 is used for description purpose, the invention is not limited thereto. The details of steps S310, S320, S330 and S340 may refer to the description of the embodiments in FIG. 1 and FIG. 2, and will not be repeated.

Based on the above, in the display device and the driving method of the display panel of the embodiments of the invention, the display panel has at least four color pixels, and the pixel voltages required to drive the pixels are generated according to at least two different gamma curves. Thereby, the gradation variation displayed by the screen is increased to improve the image layering displayed by the display panel and to optimize quality of the displayed image.

What is claimed is:

1. A display device, comprising:

a color data converting unit, receiving a first color data, a second color data, a third color data, and a fourth color data, and converting the first color data, the second color data, the third color data, and the fourth color data to a first display data, a second display data, a third display data, and a fourth display data respectively for outputting;

a display panel, having a first color pixel, a second color pixel, a third color pixel, and a fourth color pixel; and a panel driving unit, coupled to the color data converting unit and the display panel, converting the first display data, the second display data, and the third display data to a first pixel voltage, a second pixel voltage, and a third pixel voltage according to a first gamma curve, and converting the fourth display data to a fourth pixel voltage according to a second gamma curve, wherein the first pixel voltage is used to drive the first color pixel, the second pixel voltage is used to drive the second color pixel, the third pixel voltage is used to drive the third color pixel, the fourth pixel voltage is used to drive the fourth color pixel, and the first gamma curve is different from the second gamma curve.

2. The display device as recited in claim 1, further comprising:

a color calculating unit, coupled to the color data converting unit and receiving an image data, so as to supply the first color data, the second color data, the third color data, and the fourth color data according to the image data to the color data converting unit.

3. The display device as recited in claim 2, wherein a number of data bits of the first color data, the second color data, the third color data, and the fourth color data is greater than or equal to a number of data bits of the image data, and a number of data bits of the first display data, the second display data, the third display data, and the fourth display data is smaller than a number of data bits of the first color data, the second color data, the third color data, and the fourth color data.

4. The display device as recited in claim 1, wherein the display panel further comprises a fifth color pixel, the color data converting unit further receives a fifth color data to supply a fifth display data to the panel driving unit, and the panel driving unit converts the fifth display data to a fifth pixel voltage so as to drive the fifth color pixel.

5. The display device as recited in claim 4, wherein the panel driving unit converts the fifth display data to a fifth pixel voltage according to the second gamma curve.

6. The display device as recited in claim 4, wherein the panel driving unit converts the fifth display data to a fifth pixel voltage according to a third gamma curve, and the third gamma curve is different from the first gamma curve and the second gamma curve.

7. The display device as recited in claim 4, wherein chromas of the first color pixel, the second color pixel, the third color pixel, the fourth color pixel, and the fifth color pixel are different from each other.

8. A method of driving a display panel, comprises the following steps:

converting a first color data, a second color data, a third color data, and a fourth color data to a first display data, a second display data, a third display data, and a fourth display data respectively by a color data converting unit;

converting the first display data, the second display data, and the third display data to a first pixel voltage, a second pixel voltage, and a third pixel voltage according to a first gamma curve to transmit to a display panel by a panel driving unit, so as to drive a first color pixel, a second color pixel, and a third color pixel; and converting the fourth display data to a fourth pixel voltage according to a second gamma curve to transmit to the display panel by the panel driving unit, so as to drive a fourth color pixel of the display panel, wherein the first gamma curve is different from the second gamma curve.

9. The method of claim 8, further comprising:

supplying the first color data, the second color data, the third color data, and the fourth color data according to an image data to the color data converting unit by a color calculating unit.

10. The method of claim 9, wherein a number of data bits of the first color data, the second color data, the third color data, and the fourth color data is greater than or equal to a number of data bits of the image data, and a number of data bits of the first display data, the second display data, the third display data, and the fourth display data is smaller than a number of data bits of the first color data, the second color data, the third color data, and the fourth color data.

11. The method of claim 8, wherein the display panel further comprises a fifth color pixel and the driving method further comprises:

converting a fifth color data to a fifth display data to supply to the panel driving unit by the color data converting unit; and converting the fifth display data to a fifth pixel voltage by the panel driving unit, so as to drive a fifth color pixel of the display panel.

12. The method of claim 11, wherein the panel driving unit converts the fifth display data to the fifth pixel voltage according to the second gamma curve.

13. The method of claim 11, wherein the panel driving unit converts the fifth display data to the fifth pixel voltage according to a third gamma curve, and the third gamma curve is different from the first gamma curve and the second gamma curve.

14. The method of claim 11, wherein the first color pixel is a red pixel, the second color pixel is a green pixel, the third color pixel is a blue pixel, and chromas of the fourth color pixel and the fifth color pixel are different from chromas of the first color pixel, the second color pixel, and the third color pixel.

* * * * *